US009175686B2

(12) United States Patent
Johnson

(10) Patent No.: US 9,175,686 B2
(45) Date of Patent: Nov. 3, 2015

(54) PRIMING VALVE SYSTEM FOR PRE-PRIMING CENTRIFUGAL PUMP INTAKES

(75) Inventor: David William Johnson, Hastings, MN (US)

(73) Assignee: Waterous Company, South St. Paul, MN (US)

( * ) Notice: Subject to any disclaimer, the term of this patent is extended or adjusted under 35 U.S.C. 154(b) by 599 days.

(21) Appl. No.: 13/599,646

(22) Filed: Aug. 30, 2012

(65) Prior Publication Data

US 2013/0058757 A1 Mar. 7, 2013

Related U.S. Application Data

(60) Provisional application No. 61/530,622, filed on Sep. 2, 2011.

(51) Int. Cl.
*F04D 9/04* (2006.01)
*F04D 9/00* (2006.01)

(52) U.S. Cl.
CPC ..... *F04D 9/006* (2013.01); *Y10T 137/86035* (2015.04)

(58) Field of Classification Search
CPC ..... F04D 9/006; F04D 9/042; F04D 9/044; F04D 9/049; F04D 9/04
USPC ..... 415/1
See application file for complete search history.

(56) References Cited

U.S. PATENT DOCUMENTS

| | | | | |
|---|---|---|---|---|
| 2,033,981 | A | 3/1936 | Durdin, Jr. | |
| 2,758,547 | A * | 8/1956 | Wendell et al. | 417/201 |
| 2,790,393 | A | 4/1957 | Thomas et al. | |
| 2,980,391 | A * | 4/1961 | Hill | 251/210 |
| 3,151,566 | A * | 10/1964 | Durstberger | 417/202 |
| 3,578,880 | A | 5/1971 | Cygnor | |
| 6,250,889 | B1 * | 6/2001 | Shepard | 417/89 |
| 6,409,478 | B1 * | 6/2002 | Carnes et al. | 417/200 |
| 6,682,313 | B1 * | 1/2004 | Sulmone | 417/199.2 |
| 7,156,614 | B2 | 1/2007 | Racer et al. | |
| 7,334,600 | B2 * | 2/2008 | Scott | 137/202 |

OTHER PUBLICATIONS

Notification of Transmittal of the International Search Report and the Written Opinion of the International Searching Authority, or the Declaration (PCT/US2012/053163) dated Oct. 4, 2013 (14 pages).

* cited by examiner

*Primary Examiner* — Dwayne J White
*Assistant Examiner* — Joshua R Beebe
(74) *Attorney, Agent, or Firm* — Todd R. Fronek; Larkin Hoffman Daly & Lindgren, Ltd.

(57) ABSTRACT

A priming valve for priming a centrifugal pump includes a valve assembly separating an inlet chamber from an outlet chamber. The inlet chamber is fluidly coupled to an intake for the centrifugal pump and the outlet chamber is fluidly coupled to a priming pump. A control valve is provided to operate the valve assembly in order to fluidly connect the inlet chamber with the outlet chamber. While the valve assembly fluidly connects the inlet chamber with the outlet chamber, the priming pump can operate to replace air in the intake and the centrifugal pump with water.

17 Claims, 4 Drawing Sheets

PRIMING VALVE SYSTEM FOR PRE-PRIMING CENTRIFUGAL PUMP INTAKES

CROSS-REFERENCE TO RELATED APPLICATIONS

This application claims priority under 35 U.S.C. §119(e) to U.S. Provisional Patent Application Ser. No. 61/530,622 filed on Sep. 2, 2011, and incorporated herein by reference.

BACKGROUND

In order for a centrifugal pump to operate properly, a priming system is used to replace air in an intake line of the pump with water. In water delivery systems such as those used on a fire truck, current priming systems include a priming pump and corresponding priming valve to replace air in the intake lines and the centrifugal pump with water. In some instances, the centrifugal pump includes multiple intakes positioned in separate locations (e.g., front, rear, side) on the truck. In order to handle priming the centrifugal pump with multiple intakes, current priming systems include a separate priming pump for each intake. Such priming systems can be expensive to implement and maintain. In other current priming systems, a linkage (e.g., mechanical or electrical) is used to couple an operator control panel with each associated priming valve. Mechanical linkages can be cumbersome to operate, while electrical linkages to a solenoid valve can require a high amount of current (e.g., on the order of around 70 amps) to operate. As such, improvements to priming systems would be beneficial.

SUMMARY

One concept presented herein relates to a priming valve for priming a centrifugal pump includes a valve assembly separating an inlet chamber from an outlet chamber. The inlet chamber is fluidly coupled to an intake for the centrifugal pump and the outlet chamber is fluidly coupled to a priming pump. A control valve is provided to operate the valve assembly in order to fluidly connect the inlet chamber with the outlet chamber. In one particular embodiment, the control valve can operate to place atmospheric pressure on the valve assembly, which in turn fluidly couples the inlet chamber with the outlet chamber. While the valve assembly fluidly connects the inlet chamber with the outlet chamber, the priming pump can operate to replace air in the intake and the centrifugal pump with water.

In another concept, a priming valve system includes a priming pump and a plurality of priming valves fluidly coupled with the priming pump and a centrifugal pump having a plurality of intakes. Each priming valve is fluidly coupled with one of the plurality of intakes. A control system is coupled to each of the plurality of priming valves to control operation thereof. Upon selective operation of a selected priming valve to an open position and the priming pump to an on position, air is pumped out of the intake corresponding to the selected priming valve and water passes through the intake to the centrifugal pump.

In yet a further concept, a method of priming a centrifugal pump includes accessing a priming valve system having a priming pump and a plurality of priming valves fluidly coupled with the priming pump. One of the priming valves is selectively transitioned to an open position. The priming pump is operated to draw air from the intake through the selected priming valve and draw water into the intake.

DETAILED DESCRIPTION

Figure 1:
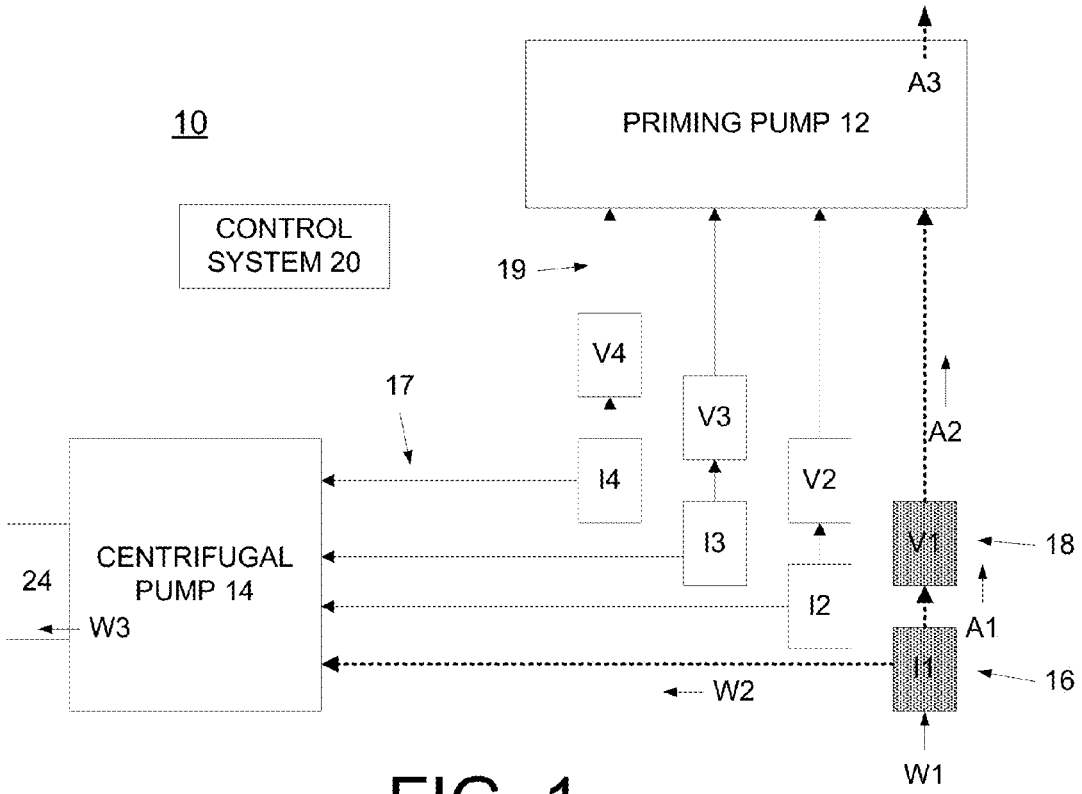
FIG. 1 is a schematic view of a priming system.

FIG. 1 is a schematic view of a priming valve system 10 having a priming pump 12 coupled with a centrifugal pump 14. A plurality of intakes 16 (denoted I1-I4) are fluidly coupled with the priming pump 12 and centrifugal pump 14. In particular, a plurality of conduits or lines (indicated generally at 17) extend between each of the plurality of intakes 16 and the centrifugal pump 14. Additionally, a plurality of conduits or lines (indicated generally at 19) fluidly couple the plurality of intakes 16 with the priming pump 12. A plurality of priming valves 18 (denoted V1-V4) are fluidly positioned between each of the plurality of intakes 16 and the priming pump 12 in order to assist in selectively priming a corresponding intake 16 and the centrifugal pump 14.

Each of the plurality of valves 18 are operable between an open position, which allows priming pump 12 to remove air from the valve's corresponding intake, and a closed position, which closes fluid flow from the corresponding intake to the priming pump 12. A control system 20 is operably connected with the priming pump 12 and the plurality of priming valves 18. In one particular embodiment, the control system 20 is configured to provide signals to the priming pump 12 to control operation and the plurality of valves 18 to selectively open and close each valve.

In one example, system 10 is a priming system for use with a water delivery system of a fire truck. Each of the individual intakes I1-I4 can be positioned on various positions of the truck. For example, the intakes I1-I4 can include a main tank intake, a front intake, a side intake, a rear intake and/or combinations thereof In alternative embodiments, the number of intakes can be a single intake or any number of multiple intakes and need not include four intakes. Regardless of the number of intakes, priming system 10 (and in particular control system 20) is able to operate each intake I1-I4 independently in order to prime the centrifugal pump 14 and the individual intake to be used. In one exemplary embodiment, priming pump 12 is a positive displacement pump that operates to remove air from the intake to be used. Once a valve is selected and operated, the other valves remain closed to allow priming pump 12 to prime an intake corresponding to the selected valve. Upon completion of priming the centrifugal pump 14, the associated priming valve is closed.

The centrifugal pump 14 can take various forms and operates as a conventional centrifugal pump with an impeller providing centrifugal force to water that enters the centrifugal pump through one of the plurality of intakes 16, which ultimately exits through an outlet 24. When used with a fire truck, the centrifugal pump 14 can draw rotational power from the fire truck engine or be driven separately as desired.

Prior to and after operation of priming system 10, the priming pump 12 is in an off position and each of the plurality of valves 18 are in a closed position. As such, the priming pump 12 and conduits 19 extending to each of the plurality of valves 18 are maintained at a constant pressure and fluidly isolated from ambient air. During operation, at least one of the plurality of intakes 16 is coupled to a water source to provide water to the centrifugal pump 14. Additionally, the priming pump 12 is switched to an on position and one of the plurality of valves 18 transitions to an open position. By way of example, to prime intake I1 and the centrifugal pump 14, the corresponding priming valve V1 is transitioned to the open position. The priming pump 12 then operates to remove air from the centrifugal pump 14 and the intake I1, as well as any conduit extending therebetween. In particular, an operator triggers a control switch coupled to the priming valve V1 and the priming pump 12. The switch powers on the priming pump 12 and opens the valve V1 such that air can pass from the intake Il to the priming pump 12 and exit to ambient air. Operation of the priming pump 12 forces air out of the intake Il such that the centrifugal pump 14 is primed. After centrifugal pump 14 is primed, the priming valve V1 can be closed and the centrifugal pump 14 can then be properly operated to continuously deliver water as desired.

Figure 2:
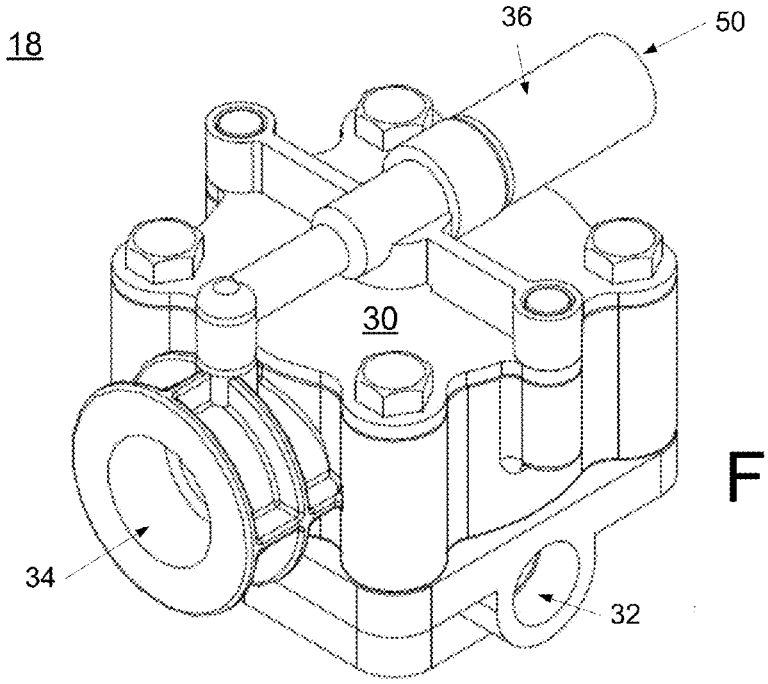
FIG. 2 is an isometric view of a priming valve.
Figure 3:
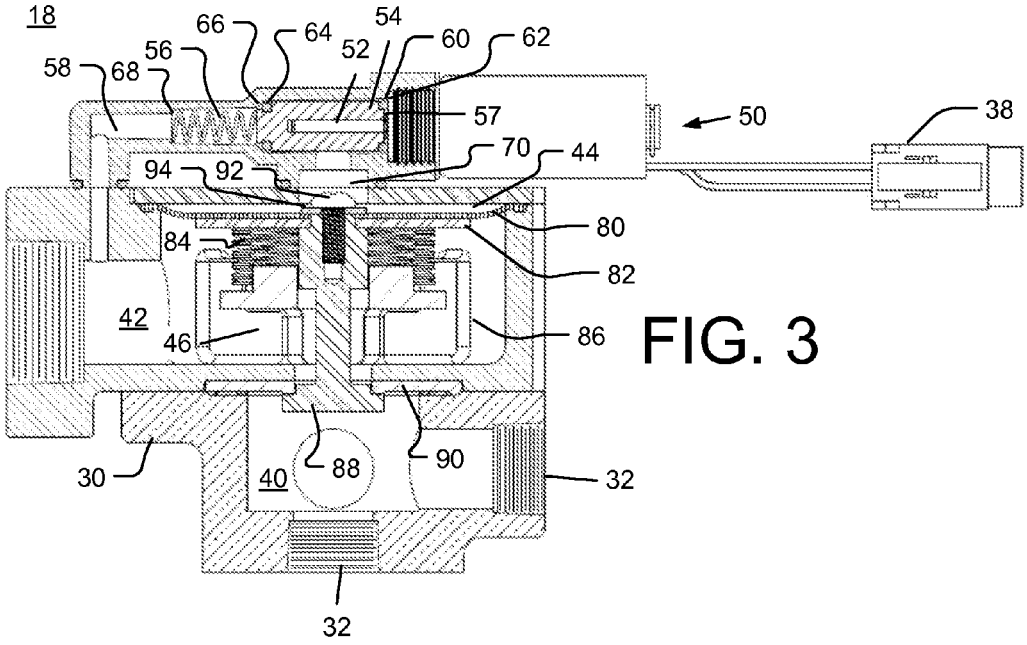
FIG. 3 is a sectional view of the priming valve of FIG. 2 in a first, closed position.
Figure 4:
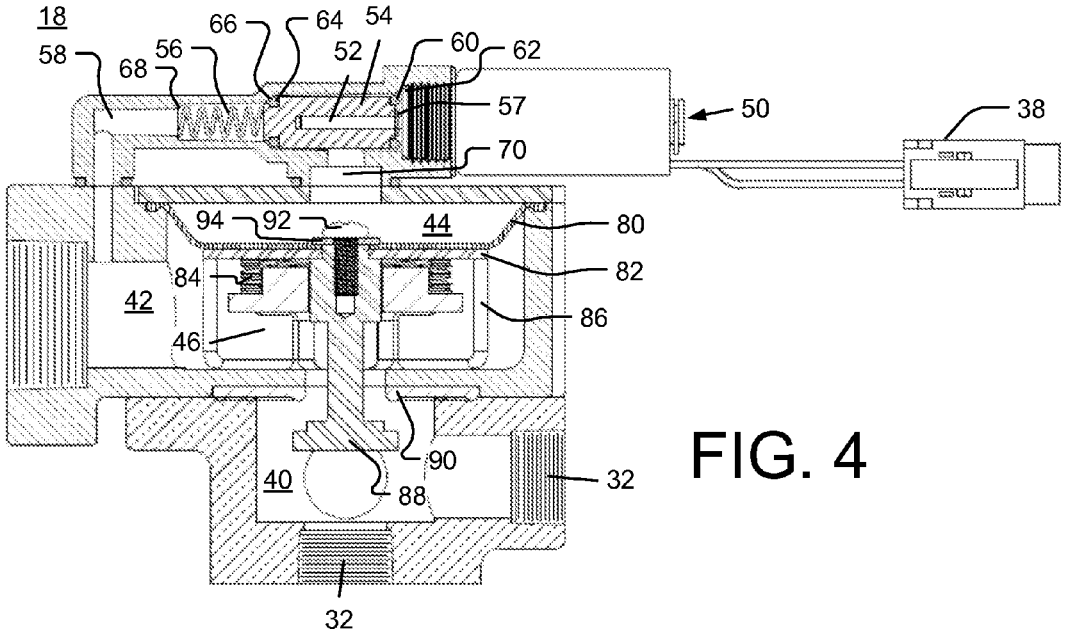
FIG. 4 is a sectional view of the priming valve of FIG. 2 in a second, open position.

FIGS. 2-4 illustrate an exemplary priming valve 18, which can be used as any of the valves V1-V4 in priming system 10 discussed above. Priming valve 18 includes a housing 30 defining a plurality of inlet ports 32 (one of which is shown in FIG. 2), an outlet port 34 and a control valve 36. Although valve 18 is illustrated with multiple inlet ports 32, valve 18 can include only a single inlet port. In one example, multiple ports can be used to accommodate connections to valve 18 of various sizes. In any event, one or more of the ports 32 are fluidly coupled to a corresponding intake 16 (FIG. 1) of system 10. Additionally, outlet port 34 is fluidly coupled to priming pump 12 through a conduit 19 (FIG. 1). Control valve 36 is electrically connected to control system 20 (FIG. 1) through a suitable connector 38 and configured to be fluidly coupled to ambient air. Connector 38 is electrically coupled to an operator switch (shown in FIG. 5) to facilitate operation of the valve. Upon operation of the switch, control valve 36 operates to fluidly connect inlet ports 32 with outlet port 34. As such, priming pump 12 can be operated to replace air in the intake 16 coupled to inlet ports 32 with water.

As best illustrated in FIGS. 3 and 4, housing 30 further defines an inlet chamber 40, an outlet chamber 42 and a control chamber 44. The plurality of inlet ports 32 are fluidly coupled to the inlet chamber 40. Similarly, outlet port 34 is fluidly coupled to the outlet chamber 42, whereas the control valve 36 is fluidly coupled to the control chamber 44. Control valve 36 can selectively expose control chamber 44 to ambient air (and thus atmospheric pressure) in order to selectively open and close a valve assembly 46. When control valve 36 is in the closed position, as illustrated in FIG. 3, control chamber 44 is isolated from ambient air. In turn, valve assembly 46 is also in a closed position such that outlet chamber 42 is fluidly isolated from inlet chamber 40. Conversely, when control valve 36 is in the open position as illustrated in FIG. 4, control chamber 44 is open to ambient air. In turn, valve assembly 46 is in an open position such that outlet chamber 42 is open to inlet chamber 40. As such, air can pass through the first chamber 40, second chamber 42 and into the priming pump 12.

Control valve 36, in the embodiment illustrated, is a solenoid valve that operates to selectively fluidly connect/disconnect control chamber 44 with ambient air. To this end, control valve 36 includes an inlet 50, a shaft 52, a piston 54 and a biasing element 56 (e.g., a spring). Piston 54 is coupled to shaft 52 using a suitable snap ring 57. On an opposite side of piston 54 from inlet 50, a passageway 58 couples control valve 36 with the outlet chamber 42. A first seal (e.g., an o-ring) 60 is provided to seal piston 54 against a shoulder 62 fluidly coupled to air inlet 50. In a similar manner, a second seal (e.g., an o-ring) 64 is provided to seal piston 54 against a shoulder 66 fluidly coupled to the passageway 58.

When control valve 36 is in the closed position as shown in FIG. 3, biasing element 56 acts against a shoulder 68 to urge seal 60 against shoulder 62, thus sealing air inlet 50 such that ambient air is prevented from entering control chamber 44 through a passageway 70. Control chamber 44 is thus fluidly coupled with the outlet chamber 42 through passageway 58. When control valve 36 is in the open position as shown in FIG. 4, control valve 36 operates to urge shaft 52 and piston 54 away from inlet 50, pressing seal 64 against shoulder 66. As such, ambient air can enter through inlet 50 and into control chamber 44 through passageway 70. This ambient air forces valve assembly 46 in a downward direction, opening inlet chamber 40 to outlet chamber 42.

In particular, valve assembly 46 includes a diaphragm 80 fluidly separating the outlet chamber 42 from the control chamber 44, a plate 82, a biasing element 84 (e.g., a spring), a retaining element 86, a valve stem 88 and a valve seat 90. A fastener 92 and washer 94 couple the diaphragm 80 and plate 82 to the valve stem 88. The biasing element 84 is positioned between the retaining element 86 and the plate 82. When control valve 36 is in the closed position of FIG. 3, seal 60 is pressed against shoulder 62, fluidly coupling outlet chamber 42 and control chamber 44. Without a pressure differential between outlet chamber 42 and control chamber 44, biasing element 84 urges plate 82 and diaphragm 80 toward the control valve 36, forcing air in chamber 44 into passageway 58.

When control valve 36 is in the open position of FIG. 4, seal 64 is pressed against shoulder 66. As outlet chamber 42 is subject to negative pressure from priming pump 12, ambient air enters inlet 50 and through passageway 70 to force diaphragm 80 to deflect and compress the biasing element 84, moving valve stem 88 out of contact with valve seat 90. As such, during operation of priming pump 12, air is allowed to pass from the corresponding intake, through one of the inlet ports 32, into inlet chamber 40, into outlet chamber 42 and through outlet port 34. In particular, with control valve 36 in an open position and priming pump 12 in operation, negative pressure in the outlet chamber 42 caused by the priming pump 12 creates a pressure differential between the control chamber 44 (which is opened to ambient air through inlet 50) and the outlet chamber 42. This differential urges diaphragm 80 to deflect downward and release valve stem 88 from engagement with valve seat 90, fluidly coupling inlet chamber 40 to outlet chamber 42.

Figure 5:
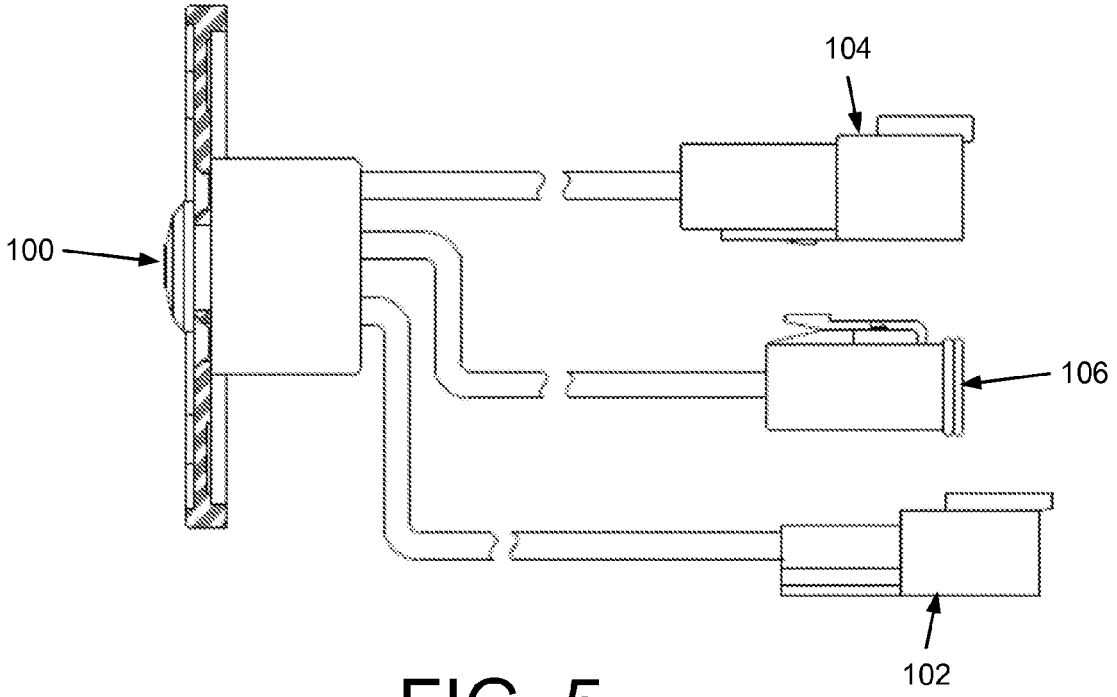
FIG. 5 is a side view of a switch for operating a priming system.

FIG. 5 illustrates a switch 100 useful in operating one of the priming valves 18 and the priming pump 12. As illustrated, switch 100 is a push button switch, where an operator can press and hold the switch 100 to effectuate opening of the control valve 36 as well as operation of the priming pump 12. To this end, switch 100 can be a single throw-double pole switch, including connectors 102, 104 and 106. In one example, connector 102 is coupled with connector 38 (FIGS. 3 and 4) to operate the control valve 36. As long as switch 100 is pressed, control valve 36 remains open to allow priming of centrifugal pump 14. In a similar manner, connector 104 is connected to the priming pump 12, such that operation of switch 100 turns on operation of the primary pump 12. Connector 106 can be coupled with control system 20 to provide a signal that switch 100 is in operation.

Figure 6:
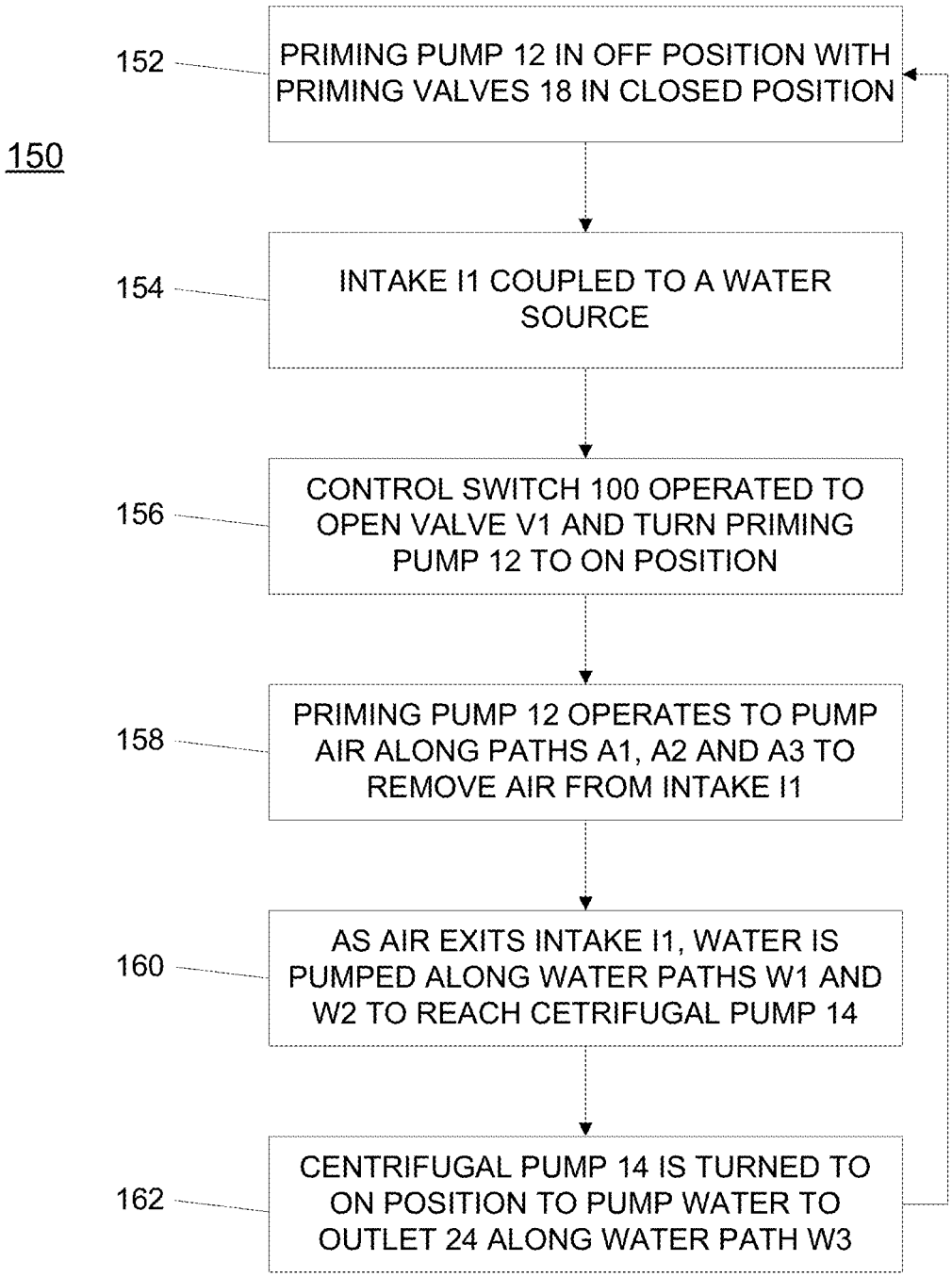
FIG. 6 is a flow diagram of an exemplary method of operating a priming system.

FIG. 6 is a flow diagram of an exemplary method for operating priming system 10 wherein valve V1 and intake I1 are used to prime centrifugal pump 14. With additional reference to FIG. 1, method 150 begins with step 152, wherein the priming pump 12 is in an off position and each of the plurality of priming valves 18 are in a closed position. As such, the priming system 10 is fluidly isolated from ambient air and maintains a constant pressure. At step 154, intake I1 is coupled to a water source. Intake I1 is illustrated with stippling to indicate its coupling with the water source.

At step 156, control switch 100 (FIG. 5) is operated to open valve V1 (also illustrated in stippling) and turn priming pump 12 to the on position. In this step, the corresponding control valve 36 is opened to expose the corresponding control chamber 44 of valve V1 to ambient air, allowing air to pass from inlet chamber 40 to outlet chamber 42. Next, at step 158, the priming pump 12 operates to remove air from intake I1. In particular, the priming pump 12 operates to pump air along air paths A1, A2 and A3, as illustrated in FIG. 1.

At step 160, as air exits intake I1, water is pumped from the water source along water paths W1 and W2 to reach the centrifugal pump 14. Water will continue to flow along paths W1 and W2 until pressure within centrifugal pump 14 reaches a value that indicates that centrifugal pump 14 is primed. The centrifugal pump 14 is turned on at step 162 to pump water to outlet 24 along water path W3. Once centrifugal pump 14 is in operation, method 150 can return to step 152, wherein the priming pump 12 is in the off position and the priming valves 18 are in the closed position. In one example, switch 100 can be released by an operator, which closes the corresponding control valve 36, moving the valve V1 to the closed position of FIG. 3.

Although the present invention has been described with reference to preferred embodiments, workers skilled in the art will recognize that changes can be made in form and detail without departing from the spirit and scope of the present invention.

What is claimed is:

1. A priming valve system coupleable with a centrifugal pump having a plurality of intakes, comprising:

a priming pump;

a plurality of priming valves each fluidly coupled with one of the plurality of intakes of the centrifugal pump, each of the plurality of priming valves being fluidly coupled with the priming pump;

a control system coupled to each of the plurality of priming valves to selectively transition each of the plurality of priming valves between an open position and a closed position, wherein upon transition of one of the plurality of priming valves to the open position and during operation of the priming pump, air is pumped out of an intake corresponding to said one of the plurality of priming valves.

2. The system of claim 1, wherein each of the plurality of priming valves include a control chamber and a control valve configured to fluidly couple the control chamber to ambient air when the priming valve is in the open position.

3. The system of claim 1, wherein each of the plurality of priming valves include an outlet chamber and a conduit fluidly coupling the outlet chamber with the priming pump and further wherein, when each of the plurality of priming valves is in the closed position and the priming pump is in an off position, each conduit, each outlet chamber and the priming pump are fluidly isolated from ambient air.

4. The system of claim 1, wherein the control system includes a plurality of switches coupled with each of the plurality of priming valves and the priming pump.

5. The system of claim 1, wherein each of the plurality of priming valves comprise:

a housing defining an inlet chamber and an outlet chamber, the inlet chamber adapted to be coupled to an associated intake of the centrifugal pump and the outlet chamber adapted to be coupled to the priming pump;

a valve assembly fluidly positioned between the inlet chamber and the outlet chamber; and a control valve connected to the control system, the control valve operably coupled to the valve assembly to fluidly connect the inlet chamber to the outlet chamber such that the priming pump can remove air from the associated intake and the centrifugal pump.

6. A method of priming a centrifugal pump having a plurality of intakes, comprising:

providing a priming system having a priming pump and a plurality of priming valves, each of the plurality of priming valves fluidly coupled to one of the plurality of intakes;

opening one of the plurality of priming valves to ambient air; and operating the priming pump to remove air from an intake corresponding with said one of the plurality of priming valves.

7. The method of claim 6, further comprising:

coupling the intake to a water source; and providing water through the intake to the centrifugal pump.

8. The method of claim 7, further comprising:

operating the centrifugal pump to transfer water to an outlet.

9. The method of claim 6, further comprising:

closing said one of the plurality of priming valves; and turning the priming pump to an off position.

10. The method of claim 6, further comprising:

fluidly isolating the plurality of priming valves and the priming pump from ambient air.

11. The method of claim 6, further comprising:

operating a switch of a control system to open said one of the plurality of priming valves and turn on the priming pump.

12. The method of claim 6, wherein each of the plurality of priming valves include:

a housing defining an inlet chamber and an outlet chamber, the inlet chamber adapted to be coupled to an associated intake of the centrifugal pump and the outlet chamber adapted to be coupled to the priming pump;

a valve assembly fluidly positioned between the inlet chamber and the outlet chamber; and a control valve operably coupled to the valve assembly to fluidly connect the inlet chamber to the outlet chamber such that the priming pump can remove air from the associated intake and the centrifugal pump.

13. A system for water delivery on a vehicle comprising:

a priming pump;

a centrifugal pump;

a plurality of intakes positioned on the vehicle and coupled with the priming pump and the centrifugal pump;

a plurality of priming valves fluidly positioned between each of the plurality of intakes and the priming pump; and a control system coupled to each of the plurality of priming valves to selectively transition each of the plurality of priming valves between an open position and a closed position, wherein upon transition of one of the plurality of priming valves to the open position and during operation of the priming pump, air is pumped out of an intake corresponding to said one of the plurality of priming valves.

14. The system of claim 13, wherein each of the plurality of priming valves include a control chamber and a control valve configured to fluidly couple the control chamber to ambient air when the priming valve is in the open position.

15. The system of claim 13, wherein each of the plurality of priming valves include an outlet chamber and a conduit fluidly coupling the outlet chamber with the priming pump and further wherein, when each of the plurality of priming valves is in the closed position and the priming pump is in an off position, each conduit, each outlet chamber and the priming pump are fluidly isolated from ambient air.

16. The system of claim 13, wherein the control system includes a plurality of switches coupled with each of the plurality of priming valves and the priming pump.

17. The system of claim 13, wherein each of the plurality of priming valves comprise:

a housing defining an inlet chamber and an outlet chamber, the inlet chamber adapted to be coupled to an associated intake of the centrifugal pump and the outlet chamber adapted to be coupled to the priming pump;

a valve assembly fluidly positioned between the inlet chamber and the outlet chamber; and a control valve connected to the control system, the control valve operably coupled to the valve assembly to fluidly connect the inlet chamber to the outlet chamber such that the priming pump can remove air from the associated intake and the centrifugal pump.

* * * * *